US009614298B2

(12) United States Patent
Kondou et al.

(10) Patent No.: US 9,614,298 B2
(45) Date of Patent: Apr. 4, 2017

(54) CRIMP TERMINAL

(71) Applicant: YAZAKI CORPORATION, Tokyo (JP)

(72) Inventors: Takaya Kondou, Shizuoka (JP); Yoshitaka Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/090,858

(22) Filed: Apr. 5, 2016

(65) Prior Publication Data

US 2016/0218445 A1 Jul. 28, 2016

Related U.S. Application Data

(63) Continuation of application No. PCT/JP2014/076774, filed on Oct. 7, 2014.

(30) Foreign Application Priority Data

Oct. 8, 2013 (JP) ..... 2013-210985

(51) Int. Cl.

| | |
|---|---|
| ***H01R 4/24*** | (2006.01) |
| ***H01B 1/02*** | (2006.01) |
| *H01R 4/62* | (2006.01) |
| *H01R 4/18* | (2006.01) |

(52) U.S. Cl.

CPC ..... *H01R 4/2404* (2013.01); *H01B 1/023* (2013.01); *H01R 4/18* (2013.01); *H01R 4/188* (2013.01); *H01R 4/185* (2013.01); *H01R 4/62* (2013.01)

(58) Field of Classification Search

CPC ..... H01R 4/185; H01R 4/188; H01R 4/203; H01R 4/206; H01R 4/183

USPC ..... 439/877–882

See application file for complete search history.

(56) References Cited

U.S. PATENT DOCUMENTS 4,621,887 A * 11/1986 Piscitelli ..... H01R 13/111 439/843

6,450,831 B2 * 9/2002 Aoyama ..... H01R 4/185 439/399

FOREIGN PATENT DOCUMENTS

| | | |
|---|---|---|
| JP | S60-50461 U | 4/1985 |
| JP | 2003-243057 A | 8/2003 |
| JP | 2009-123623 A | 6/2009 |
| JP | 2010-198789 A | 9/2010 |

* cited by examiner

*Primary Examiner* — Gary Paumen

(74) *Attorney, Agent, or Firm* — Mots Law, PLLC

(57) ABSTRACT

A crimp terminal is provided with a core wire crimping part having a bottom part and a caulking piece part that extends from a side of the bottom part. The core wire crimping part crimps a core wire composed of a plurality of strands of an electric wire. A number of triangular serrations are provided on a face of the core wire crimping part to which the core wire is crimped.

6 Claims, 6 Drawing Sheets

CRIMP TERMINAL

CROSS REFERENCE TO RELATED APPLICATION

This application is a Continuation of PCT Application No. PCT/JP2014/076774, filed on Oct. 7, 2014, and claims the priority of Japanese Patent Application No. 2013-210985, filed on Oct. 8, 2013, the content of both of which is incorporated herein by reference.

TECHNICAL FIELD

The present invention relates to a crimp terminal connected to an electric wire.

BACKGROUND

As a conventional crimp terminal, there is one disclosed in Japanese patent application laid-open publication No. 2009-123623 (patent literature 1). As shown in FIG. 1 and FIG. 2, an electric wire W to which a crimp terminal 110 is connected has a core wire 101 composed of a plurality of strands 101*a* and an insulating sheath 102 that covers the periphery of the core wire 101. At the tip side of the electric wire W, the insulating sheath 102 is removed to expose the core wire 101.

The crimp terminal 110 has a counterpart terminal connection part 111 and an electric wire connection part 115. The electric wire connection part 115 has a core wire crimping part 116 and a sheath crimping part 117. The core wire crimping part 116 has a bottom part 116*a* and a pair of caulking piece parts 116*b* that extend from both sides of the bottom part 116*a*. Three long grooves (serrations) 118 are formed on the inner surface of the bottom part 116*a* and the pair of caulking piece parts 116*b* of the core wire crimping part 116. The long grooves 118 are arranged to have a direction orthogonal to the axial direction of the core wire 101 as their longitudinal direction. The sheath crimping part 117 has a bottom part 117*a* and a pair of caulking piece parts 117*b* that extend from both sides of the bottom part 117*a*.

The crimp terminal 110 caulkingly crimps the exposed core wire 101 with the core wire crimping part 116 and caulkingly crimps the insulating sheath 102 with the sheath crimping part 117.

LITERATURE LIST

Patent Literature

Patent literature 1: Japanese Patent Application Laid Publication No. 2009-123623

SUMMARY OF THE INVENTION

Problem to be Solved by the Invention

However, in the above conventional crimp terminal 110, the serrations are long grooves 118. The long grooves 118 have a long dimension in the direction orthogonal to the axial direction of each strand 101*a*, but have a small dimension in the axial direction of each strand 101*a*. Therefore, each strand 101*a* of the core wire 101 cannot come deeply into each long groove 118. When each strand 101*a* cannot come deeply into the long grooves 118, a newly formed surface due to the stretch does not occur to each strand 101*a* in a process of caulking crimping of the core wire crimping part 116, and adhesion does not occur. There was a problem that when the adhesion does not occur between each strand 101*a*, the conducting characteristics between the strands 101*a* do not improve and electric resistance at the electrical connection point becomes high.

The present invention was made to solve the above described problem and it aims to provide a crimp terminal that can reduce electric resistance at an electrical connection point with the electric wire.

Means to Solve the Problem

A first aspect of the present invention provides a crimp terminal which includes a core wire crimping part having a bottom part and a caulking piece part that extends from a side of the bottom part, in which the core wire crimping part crimps a core wire composed of a plurality of strands of an electric wire, and in which a number of triangular serrations are provided on a surface of the core wire crimping part to which the core wire is crimped.

Each of the triangular serrations may be arranged in a direction in which one side thereof becomes parallel to a direction orthogonal to an axial direction of the core wire. Each of the serrations may have an equilateral triangular shape.

Advantageous Effect of the Invention

According to the first aspect of the present invention, since the triangular serrations can secure a size of the degree in which the strands can enter in both the axial direction of the core wire and its orthogonal direction, each strand for example securely comes into the serrations deeply in the caulking crimping process of the core wire crimping part and an occurrence of a newly formed surface due to the stretch can be facilitated Thus, adhesion occurs and the conducting characteristics between the strands improve. Thus, electric resistance at the electrical connection point is reduced.

Since the triangular serrations can be arranged such that edges in the direction orthogonal to the axial direction of the core wire and edges in a direction other than the axial direction of the core wire are increased while edges in the axial direction of the core wire are eliminated, an original function of stretching each strand in the axial direction in the caulking crimping process of the core wire crimping part can be effectively exerted.

BRIEF DESCRIPTION OF DRAWINGS

FIGS. 4A, 4B, 4C show one embodiment of the present invention in which FIG. 4A is a side view of the crimp terminal to which the electric wire has been crimped; FIG. 4B is an enlarged cross sectional vim of a main part of FIG. 4A; and FIG. 4C is a sectional view taken along line A-A of FIG. 4A.

FIGS. 5A, 5B, 5C show one embodiment of the present invention in which FIG. 5A is an enlarged plan view of a main part of serration portions of the core wire crimping part; FIG. 5B is a cross sectional view showing a state in which strands have entered into a serration; and FIG. 5C is a plan view for explaining that the compressive force is acted upon between the strands that have come into the serration.

DESCRIPTION OF EMBODIMENTS OF THE INVENTION

Figure 1:
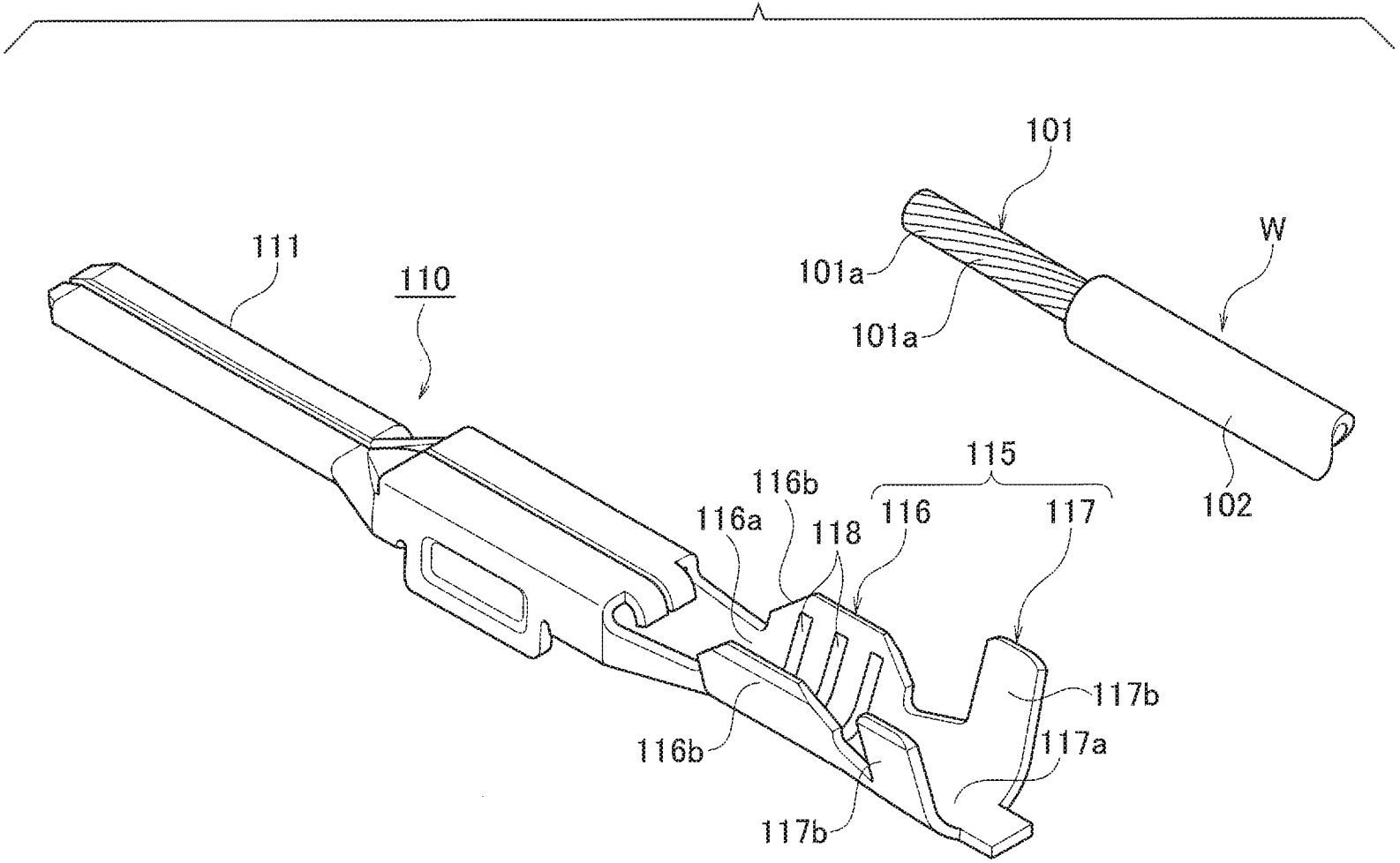
FIG. 1 PRIOR ART
FIG. 1 shows a conventional example and is a perspective view before an electric wire is crimped to a crimp terminal.
Figure 2:
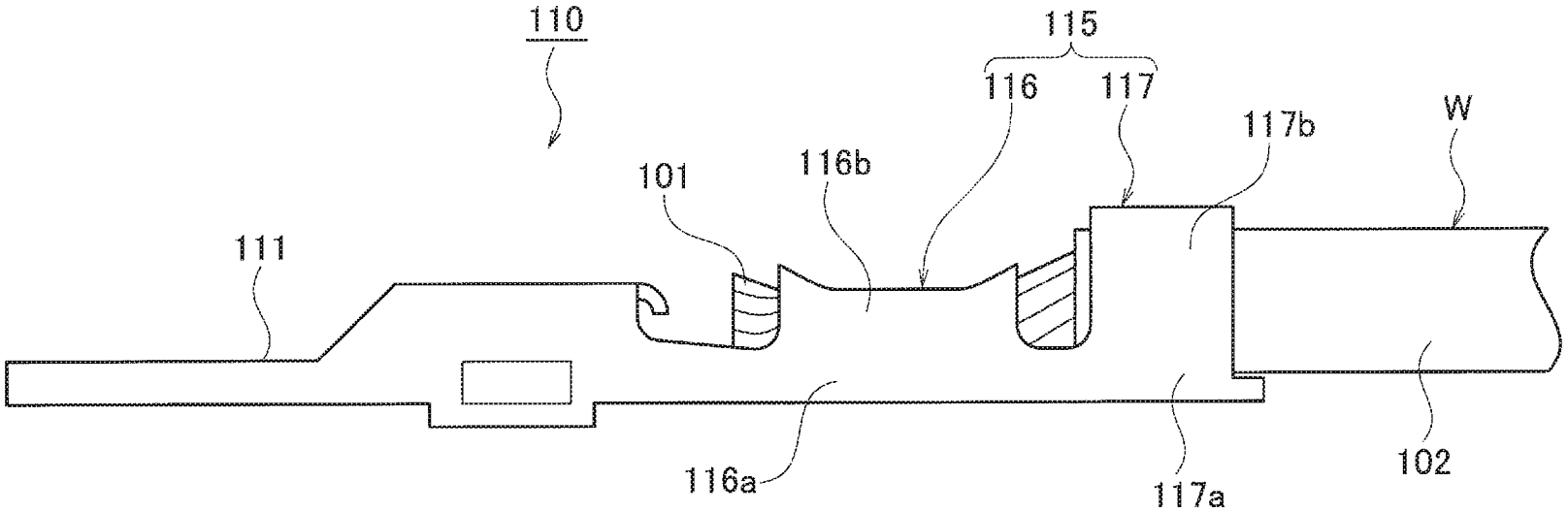
FIG. 2 PRIOR ART
FIG. 2 shows a conventional example and is a side view of the crimp terminal to which the electric wire has been crimped.
Figure 3:
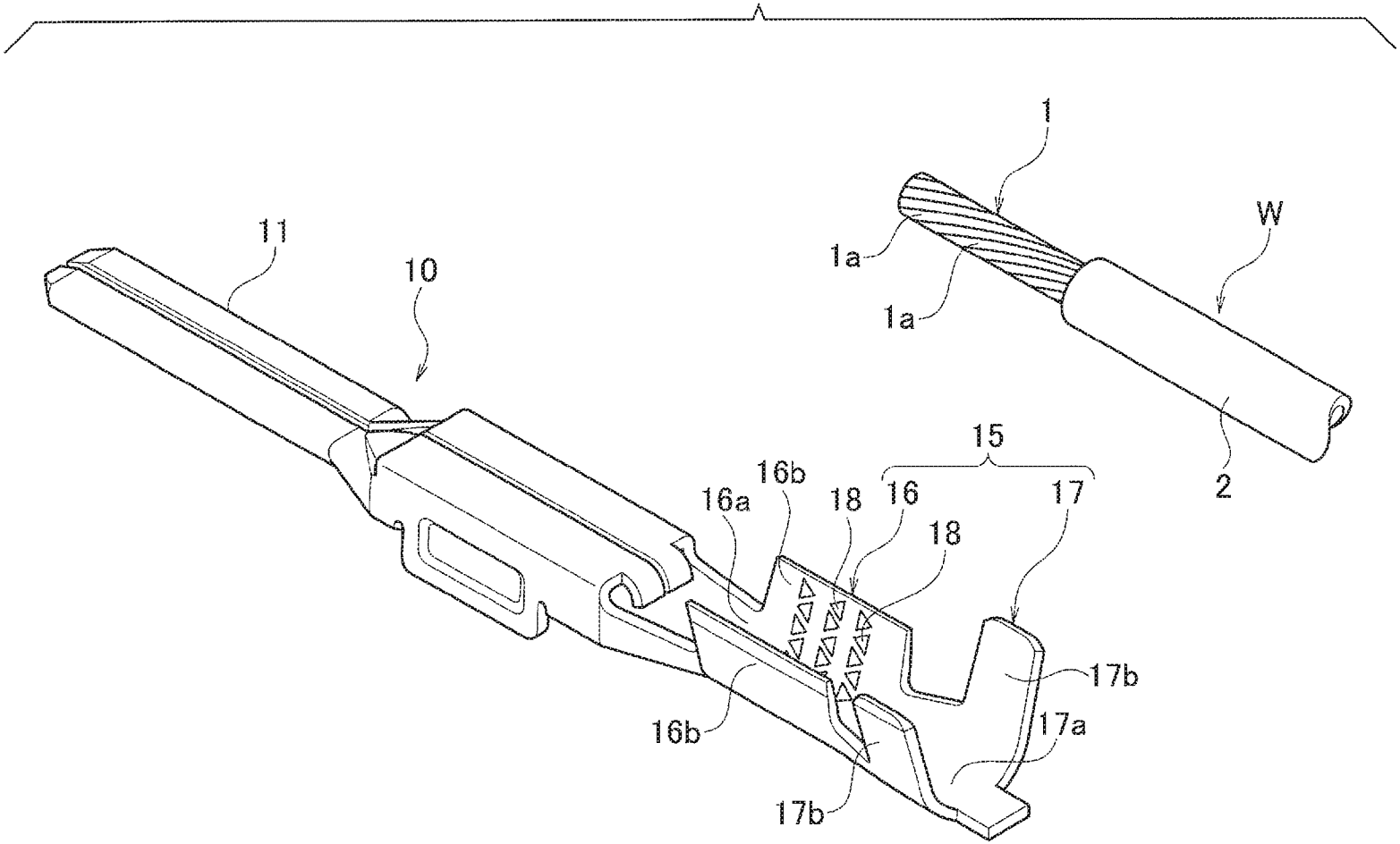
FIG. 3 shows one embodiment of the present invention and is a perspective view before an electric wire is crimped to a crimp terminal.
Figure 4A:
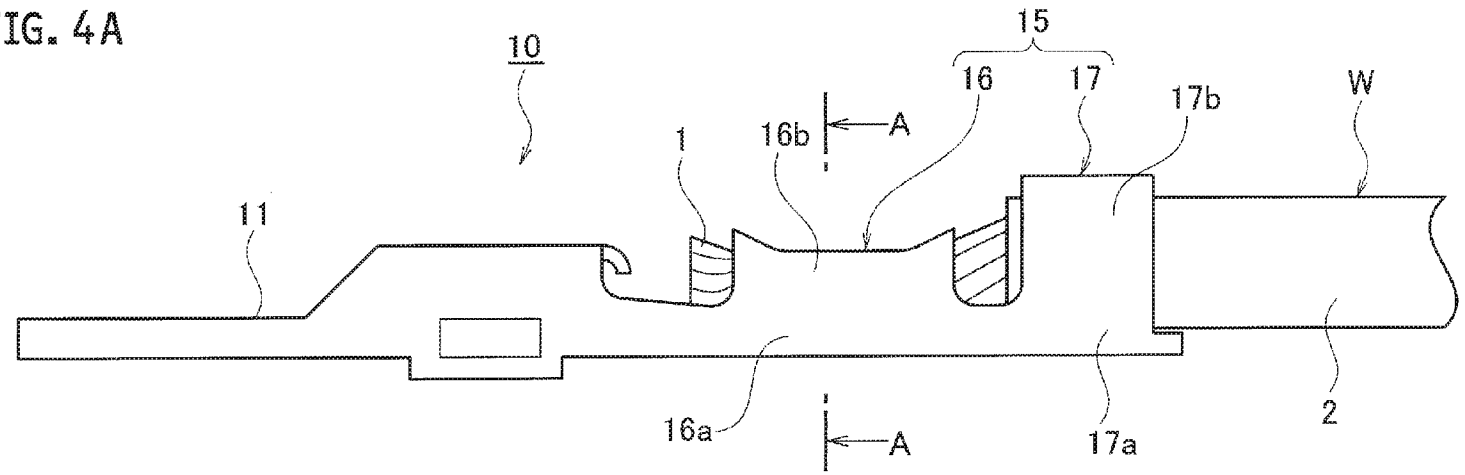
Figure 4B:
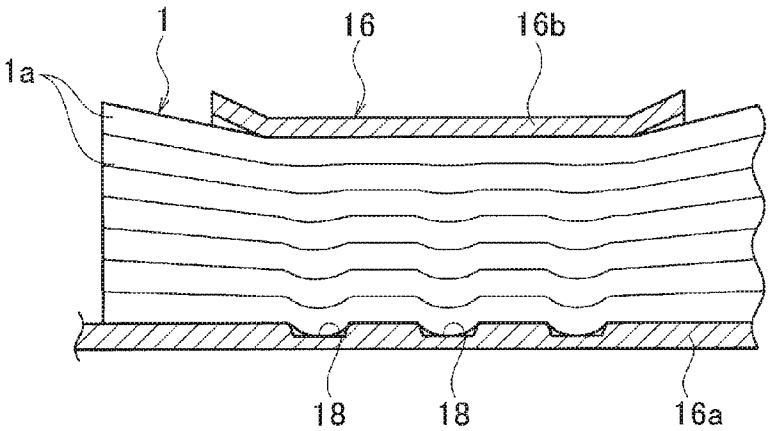
Figure 4C:
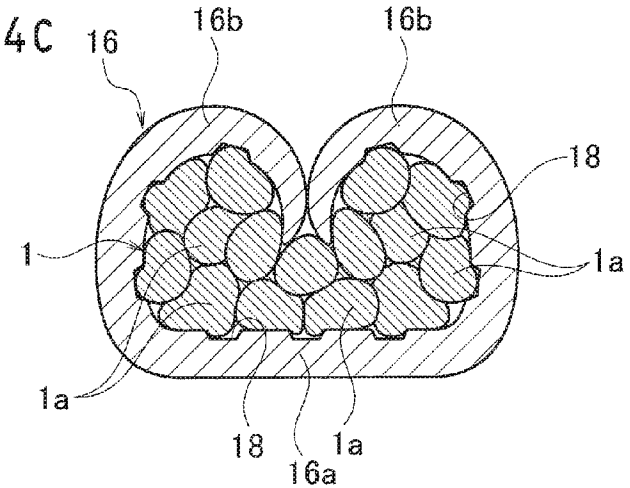

Hereinafter, one embodiment of the present invention will be explained based on the drawings.

FIGS. 3-7 show one embodiment of the present invention. As shown in FIG. 3 and FIGS. 4A, 4B, 4C, an electric wire W has a core wire 1 composed of a plurality of strands 1*a* and an insulating sheath 2 that covers the periphery of the core wire 1. At the tip side of the electric wire W, the insulating sheath 2 is removed to expose the core wire 1. The core wire 1 is composed of a number of strands 1*a* made of aluminum or an aluminum alloy (hereinafter, made of aluminum), and the number of strands 1*a* are twisted with each other, in other words, the electric wire W is an aluminum electric wire.

The crimp terminal 10 is made of a copper alloy and is formed by bending a plate that is cut into a predetermined shape. The crimp terminal 10 has a counterpart terminal connection part 11 and an electric wire connection part 15. The electric wire connection part 15 has a core wire crimping part 16 and a sheath crimping part 17. The core wire crimping part 16 has a bottom part 16*a* and a pair of caulking piece parts 16*b* that extend from both sides of the bottom part 16*a*.

Figure 5A:
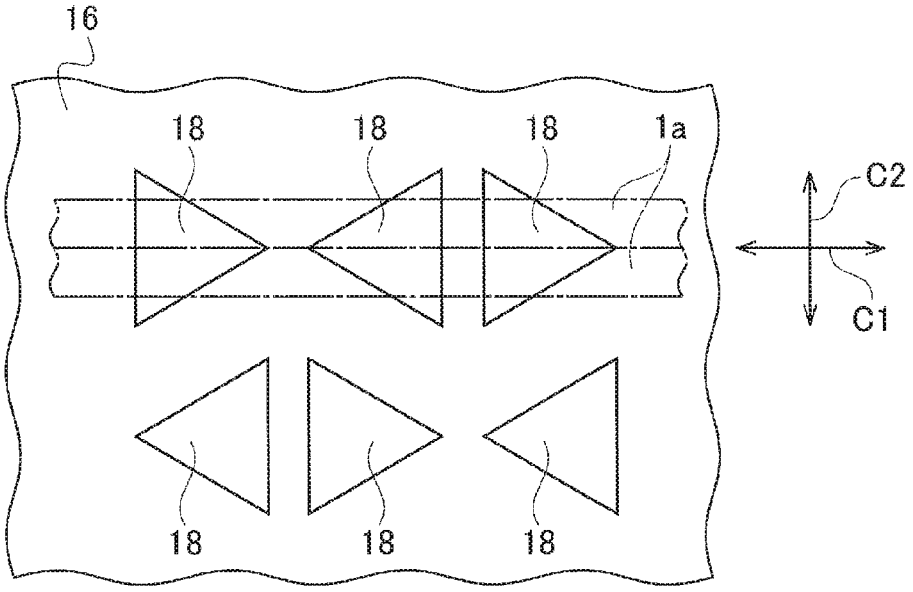
Figure 5B:
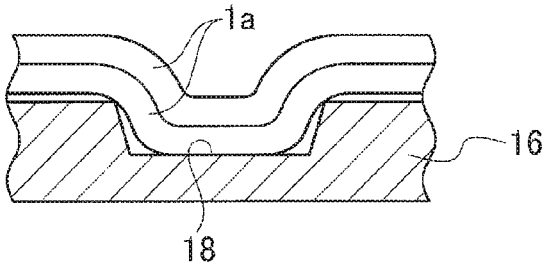
Figure 5C:
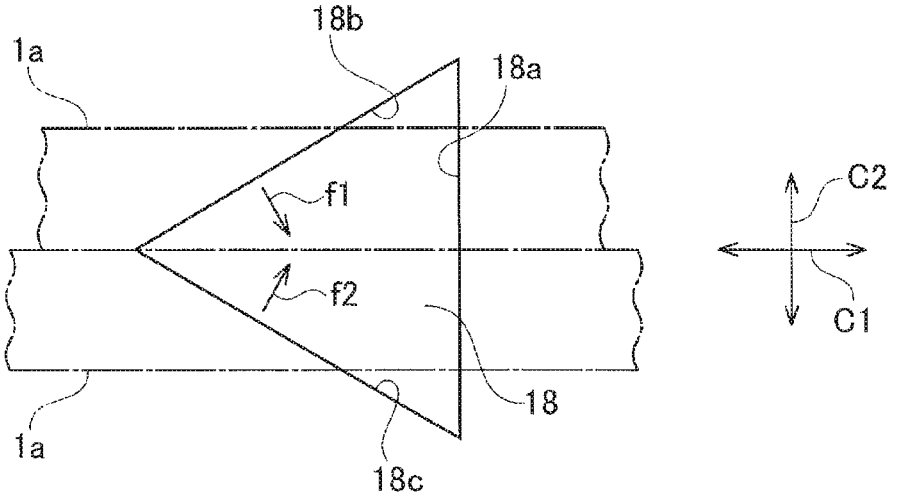

A number of equilateral triangular serrations 18 are formed on the inner surface (the face to which the core wire 1 is crimped) of the bottom part 16*a* and the pair of caulking piece parts 16*b* of the core wire crimping part 16. The serrations 18 are equilateral triangular grooves as shown in FIGS. 5A, 5B in detail. Each equilateral triangular serration 18 has a groove size of the degree in Which the strands 1*a* can enter in both the axial direction C1 of the core wire 1 (as shown in FIG. 5A) and its orthogonal direction C2 (as shown in FIG. 5A). Each serration 18 of the equilateral triangular shape is arranged in such a direction that its one side 18*a* (as shown in FIG. 5C) becomes in the direction C2 orthogonal to the axial direction of the core wire 1. The arrangement of the equilateral triangular serrations 18 is in a pattern in which ones that are adjacent to each other in the axial direction C1 of the core wire 1 and ones that are adjacent to each other in the orthogonal direction C2 to the axial direction of the core wire 1 become in different directions with each other. With this, the arrangement number of the serrations 18 per unit area is made larger.

The sheath crimping part 17 has a bottom part 17*a* and a pair of caulking piece parts 17*b* that extend from both sides of the bottom part 17*a*.

The crimp terminal 10 caulkingly crimps the exposed core wire 1 with the core wire crimping part 16 and caulkingly crimps the insulating sheath 2 with the sheath crimping part 17.

Figure 6:
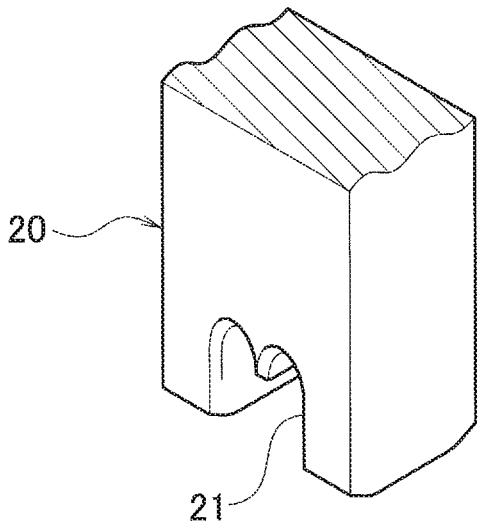
FIG. 6 is a perspective view of a caulking jig in one embodiment of the present invention.
Figure 7:
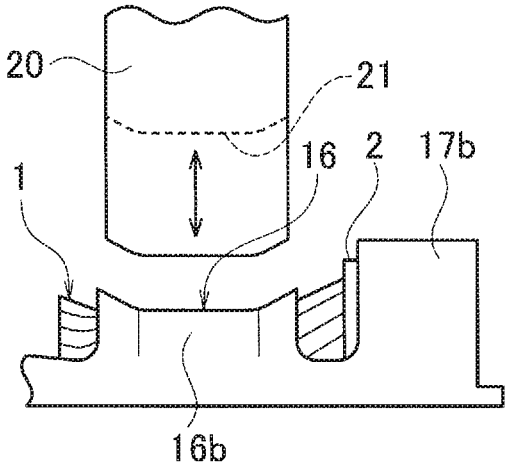
FIG. 7 shows one embodiment of the present invention and is a side view that explains a caulking operation with the caulking jig.

The crimp terminal 10 is crimped with a caulking jig 20 which is shown in FIG. 6. The caulking jig 20 has a caulking groove 21 of an ultimate caulking periphery shape on its caulking tip side. As shown in FIG. 7, when pressing the pair of caulking piece parts 16*b* with the caulking jig 20, the pair of caulking piece parts 16*b* are plastically deformed along the caulking groove 21.

In this caulking process, the core wire 1 receives the crimping force by the core wire crimping part 16. Here, since the size of the equilateral triangular serrations 18 is secured for the strands 1*a* to enter in both the axial direction C1 of the core wire 1 and its orthogonal direction C2, each strand 1*a* securely comes deeply into the serrations 18 and an occurrence of a newly formed surface due to the stretch can he facilitated. With this, adhesion occurs and the conducting characteristics between the strands 1*a* improve. Thus, electric resistance at the electrical connection point is reduced.

Since the equilateral triangular serrations 18 are arranged such that edges in the direction C2 orthogonal to the axial direction of the core wire 1 and edges in a direction other than the axial direction C1 of the core wire 1 are increased while edges in the axial direction C1 of the core wire 1 are eliminated, an original function of stretching each strand 1*a* in the axial direction C1 in the caulking crimping process of the core wire crimping part 16 is effectively exerted. More precisely, the edges in the direction (2 orthogonal to the axial direction of the core wire 1 exert a function of stretching each strand 1*a* in the axial direction C1, but the edges in the axial direction C1 of the core wire 1 do not have a function of stretching each strand 1*a* in the axial direction C1. For such reasons, the equilateral triangular serrations 18 can facilitate an occurrence of adhesion and can effectively reduce electric resistance at the electrical connection point. Moreover, the equilateral triangular serrations 18 are easy to manufacture Since an occurrence of a newly formed surface is facilitated by each strand 1*a* that comes into contact with or close to an inner surface of the core wire crimping part 16 entering the serrations 18 deeply, adhesion between the core wire 1 and the core wire crimping part 16 also occurs and is facilitated. Therefore, it reduces conducting resistance between the core wire 1 and the core wire crimping part 16 (crimp terminal 10). With this also, electric resistance at the electrical connection point is reduced. Moreover, since each strand 1*a* securely comes deeply into the serrations 18, it also improves tensile strength (improves mechanical strength) between the core wire 1 and the core wire crimping part 16.

Since the conducting characteristics of the core wire 1 at the electrical connection point can be improved by changing the design of a part of the crimp terminal 10, electric resistance at the electrical connection point can be reduced while hardly increasing the cost as compared with making it a solid wire or the like.

The core wire 1 is made of aluminum. The aluminum strands 1*a* have a thicker oxide film on the surface as compared with ones made of a copper alloy. Thus, the aluminum core wire 1 had a problem of increased electric resistance due to conducting resistance between the strands 1*a*, but in the present embodiment, since the conducting resistance between the strands 1*a* can be reduced, it is particularly effective with an aluminum electric wire. The aluminum core wire 1 is softer as compared with that made of a copper alloy and is easier to stretch, and thus, the present embodiment is effective particularly with an aluminum electric wire from this standpoint also, since the compressive force by caulking crimping of the core wire crimping part 16 can be made to act upon the core wire 1 efficiently due to the above described reasons.

Next, differences with a case in which the shape of the serrations is circular or quadrangular (including rhomboid) will be explained.

In a case that the shape of the serrations 18 is equilateral triangular (including a triangle other than the equilateral triangle), the arrangement number per unit area can be made larger compared with the circular or quadrangular shapes. Moreover, in a case that the serrations are in a Circular shape, while the strands 1*a*. can be made to securely enter deeply, edges in the direction C2 that is orthogonal to the axial direction of the core wire 1 cannot be increased. In a case that the serrations are in a quadrangular shape, while the strands 1*a* can be made to securely enter deeply and edges in the direction C2 orthogonal to the axial direction of the core wire 1 can be increased, edges in the axial direction C1 of the core wire 1 occur. In a case of rhombus, edges close to the axial direction C1 of the core wire I occur. In contrast, the equilateral triangular (including a triangle other than the equilateral triangle) serrations 18 can increase edges in the direction C2 orthogonal to the axial direction of the core wire 1 (the edge of the side 18*a*) and can eliminate edges in the axial direction C1 of the core wire 1 as well as edges close to it, as shown in FIG. 5C. In addition, as shown in FIG. 5C, since edges of the side 18*b* and the side 18*c* cause reactive forces f1, f2 to act upon in a direction of causing each strand 1*a* that enters within the serration 18 to crimp with each other, it has an advantage of facilitating adhesion between the strands 1*a*.

(Variations)

While the serrations 18 have an equilateral triangular shape in the embodiment, they can also have a triangular shape other than the equilateral triangle. For example, they can have an isosceles triangular shape or other triangular shape.

In the embodiment, the serrations 18 are grooves, but they can also be protrusions or both grooves and protrusions. In other words, in the present specification, the serrations mean grooves or protrusions that are formed on the surface.

In the embodiment, while the core wire 1 is made of aluminum, the present invention can also be applied to a core wire 1 other than that made of aluminum (for example made of a copper alloy).

What is claimed is:

1. A crimp terminal, comprising:

a core wire crimping part having a bottom part and a caulking piece part that extends from a side of the bottom part, wherein the core wire crimping part crimps a core wire composed of a plurality of strands of an electric wire, wherein a number of triangular serrations are provided on a surface of the core wire crimping part to which the core wire is crimped, wherein the number of triangular serrations are provided to increase edges of the number of triangular serrations in an orthogonal direction to an axial direction of the core wire and in a direction other than the axial direction of the core wire and eliminate edges in the axial direction of the core wire such that the edges of the number of the triangular serrations stretch each of the plurality of strands of the electric wire, and wherein an arrangement of the triangular serrations is in a pattern in which the serrations that are adjacent to each other in an axial direction of the core wire and the serrations that are adjacent to each other in an orthogonal direction to the axial direction of the core wire become in different directions with each other.

2. The crimp terminal according to claim 1, wherein each of the triangular serrations is arranged in a direction in which one side thereof becomes parallel to a direction orthogonal to an axial direction of the core wire.

3. The crimp terminal according to claim 1, wherein each of the serrations has an equilateral triangular shape.

4. The crimp terminal according to claim 2, wherein each of the serrations has an equilateral triangular shape.

5. The crimp terminal according to claim 1, wherein the number of triangular serrations is provided to increase the edges of the number of triangular serrations in the orthogonal direction to the axial direction of the core wire and eliminate the edges in the axial direction of the core wire such that the edges of the number of the triangular serrations in the orthogonal direction to the axial direction of the core wire cause reactive forces to act in directions causing ones of the plurality of strands of the electric wire that enter ones of the triangular serrations to crimp with others of the plurality of strands of the electric wire to facilitate adhesion between the plurality of strands of the electric wire.

6. The crimp terminal according to claim 1, wherein the number of triangular serrations is provided to increase the edges of the number of triangular serrations in the orthogonal direction to the axial direction of the core wire and in the direction other than the axial direction of the core wire and eliminate the edges in the axial direction of the core wire such that the stretching of each of the plurality of strands of the electric wire exposes a newly formed surface on ones of the plurality of the strands of the electric wire that come into contact with the edges of the number of the triangular serrations and adhesion between the core wire and the core wire crimping part is facilitated and conducting resistance between the core wire and the core wire crimping part is reduced.

* * * * *